US006050566A

United States Patent [19]

Shameson

[11] Patent Number: 6,050,566

[45] Date of Patent: Apr. 18, 2000

[54] CHROMATICUBE: A TRANSPARENT COLORED THREE-DIMENSIONAL PUZZLE

[76] Inventor: Abraham Shameson, 947 Colonial La., Palo Alto, Calif. 94303

[21] Appl. No.: 09/193,080

[22] Filed: Nov. 16, 1998

[51] Int. Cl.[7] ..... A63F 9/08

[52] U.S. Cl. ..... 273/156; 273/160

[58] Field of Search ..... 273/153 R, 156, 273/160, 157 R

[56] References Cited

U.S. PATENT DOCUMENTS

| | | | |
|---|---|---|---|
| D. 206,336 | 11/1966 | Wilson | 273/160 |
| 2,398,011 | 4/1946 | Kaplan | 273/160 |
| 3,924,376 | 12/1975 | Tsurumi | 273/160 |
| 4,153,254 | 5/1979 | Marc | 273/160 |
| 4,643,427 | 2/1987 | Wozniak | 273/160 |
| 4,662,638 | 5/1987 | Vachek | 273/160 |

*Primary Examiner*—Steven Wong

[57] ABSTRACT

A puzzle emphasizing its three-dimensional character, through its pieces, final form, transparency, and use of color. The completed puzzle, a transparent colored cube, consists of thirty-eight pieces, which are three-dimensional in character, not merely extruded from two dimensions. The solution and appearance of the puzzle is dependent upon its interior structure of form and color. The completed cube, six units to a side, is formed by six truncated pyramids of color. The completed cube is left with a cubic void, two units to a side, at its center. The base of each pyramid acts as a side of the cube. Pyramids opposite one another are of the same primary color: blue, red, or yellow. Pyramids adjacent to one another are of a different primary color. The appearance of the assembled cube changes drastically from different vantage points.

3 Claims, 7 Drawing Sheets

CHROMATICUBE: A TRANSPARENT COLORED THREE-DIMENSIONAL PUZZLE

BACKGROUND

1. Field of Invention

This invention is a three-dimensional puzzle requiring assembly of transparent colored pieces.

2. Description of Prior Art

There are many three-dimensional puzzles requiring assembly of pieces. Some puzzles are opaque, and some are transparent. The interior structure, so important to the solution of a three-dimensional puzzle, is not apparent in an opaque puzzle. In most transparent puzzles, the interior structure, although visible, is incidental to the assembled puzzle. There are puzzles consisting of pieces, which are extrusions of two-dimensional forms, or layers of such extrusions, such as "double decker" pieces. These pieces consist of two extruded two-dimensional pieces layered one on another and bound to create a single piece. These types of pieces are incidental to the form of the assembled puzzle.

OBJECTS AND ADVANTAGES

Accordingly, several objects and advantages of my puzzle are:

(a) to use pieces which are not extruded from two dimensions, but truly three-dimensional in character;

(b) to make visible the interior of the solved puzzle, by using transparent material;

(c) to make the solution of the puzzle dependent upon the interior structure of form and color, not just surface;

(d) to make the solved puzzle's appearance dependent upon vantage point, by the use of different combinations of transparent color in the line of sight.

(e) To make the solved puzzle's appearance dependent upon the direction and type of light, by different blending of colors.

DRAWING FIGURES

In the drawings, closely related figures have the same number but different alphabetic suffixes.

NUMERALS IN DRAWINGS

Figure 1:
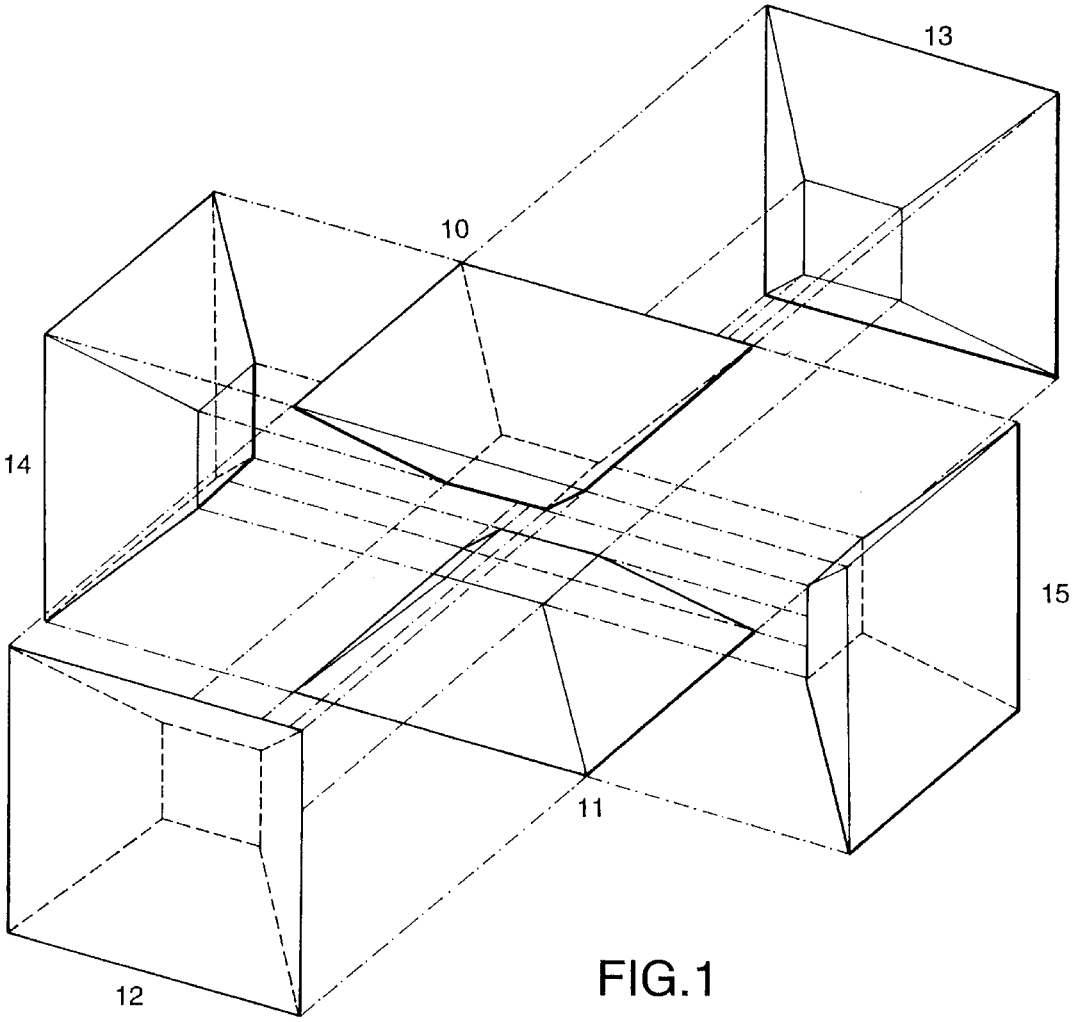
FIG. 1 shows the color scheme upon which the puzzle is based.

10 blue truncated pyramid
11 blue truncated pyramid
12 red truncated pyramid
13 red truncated pyramid

14 yellow truncated pyramid
15 yellow truncated pyramid
16 a manufactured part of "piece 3"
17 a manufactured part of "piece 3"

DESCRIPTION—FIGS. 1 TO 6, 8

The puzzle was conceived from, and follows the color scheme illustrated in FIG. 1. The overall form of the puzzle is a cube, six units to a side; with a cubic void, two units to a side, at its center. Each truncated pyramid (as seen in FIG. 1) is of a primary color: blue, red, or yellow. Pyramids opposite to one another are of the same color. 10 and 11 are blue; 12 and 13 are red; 14 and 15 are yellow. The pieces of the puzzle are governed by this color scheme.

Figure 2:
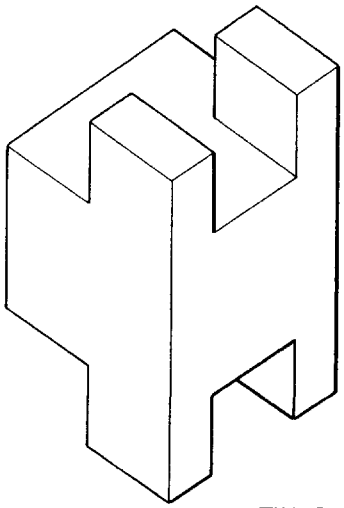
FIG. 2 shows "piece 1".
Figure 3:
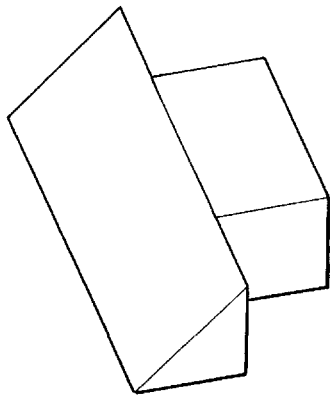
FIG. 3 shows "piece 2".
Figure 4A:
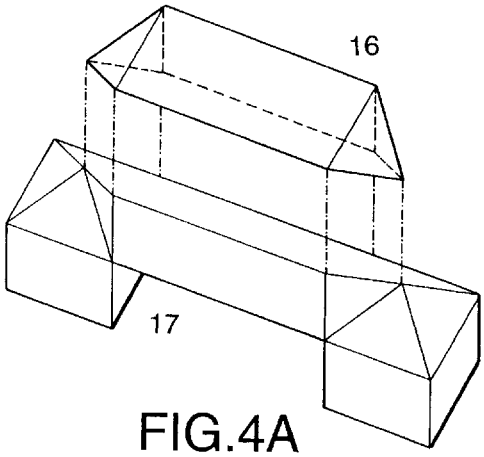
FIG. 4A shows the two manufactured parts, of different color, comprising "piece 3".
Figure 4B:
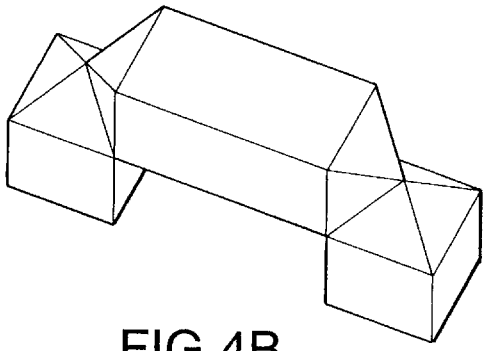
FIG. 4B shows "piece 3".
Figure 5A:
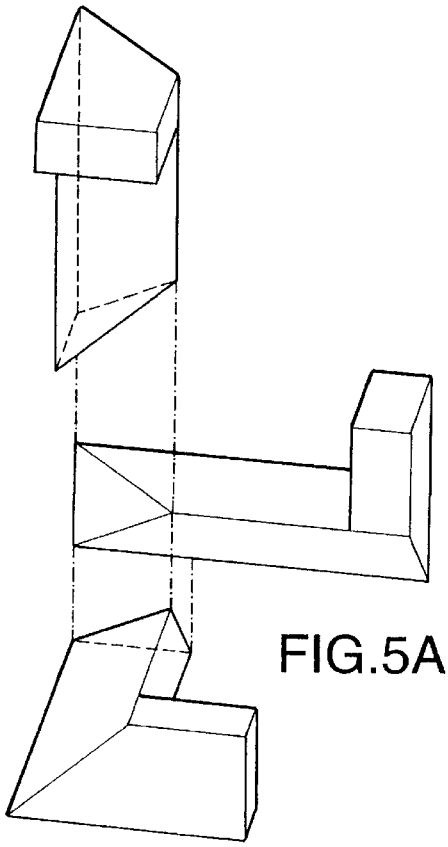
FIG. 5A shows the three manufactured parts, of identical shape but different color, "piece 4".
Figure 5B:
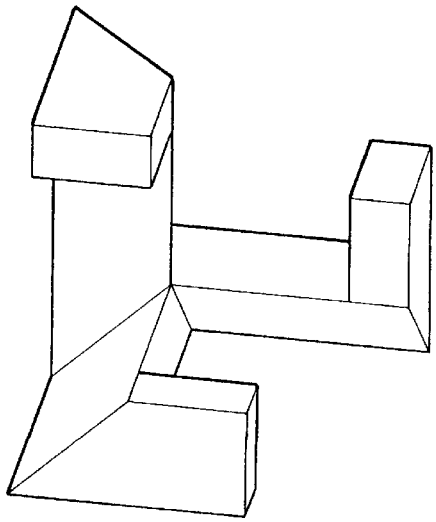
FIG. 5B shows "piece 4".
Figure 6A:
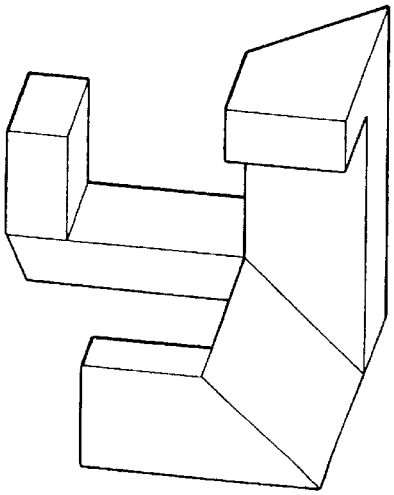
FIG. 6A shows "piece 5".
Figure 6B:
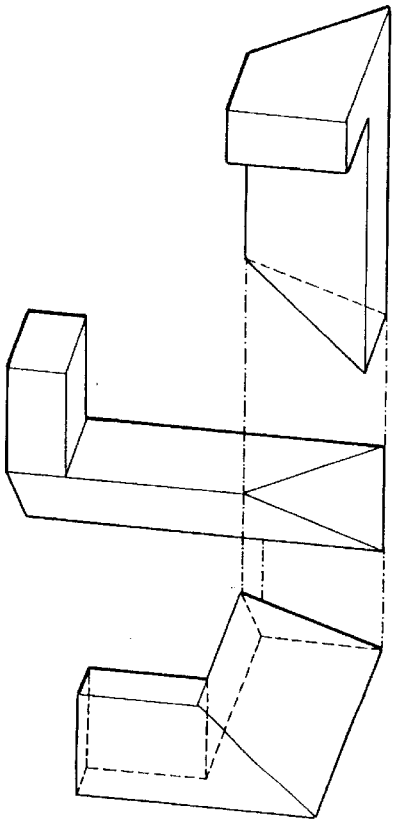
FIG. 6B shows the three manufactured parts, of identical shape but different color, "piece 5".

The puzzle is comprised of a total of 38 pieces, some of which are single-colored, and some of which are multi-colored. FIG. 2 shows "piece 1", of which there are six: two blue, two red, and two yellow. FIG. 3 shows "piece 2", of which there are twelve: four blue, four red, and four yellow. FIG. 4A, shows the two manufactured parts (16 and 17) comprising "piece 3" (as shown in FIG. 4B). There are twelve pieces of the "piece 3" type. In four of these pieces, 16 is red and 17 is yellow; in another four, 16 is yellow and 17 is blue; and in the other four, 16 is blue and 17 is red. FIG. 5A shows the three manufactured pieces comprising "piece 4" (shown in FIG. 5B), of which there are four. Each of the three manufactured parts comprising "piece 4" is of a different color: blue, red, and yellow. FIG. 6A shows "piece 5", a mirror image of "piece 4". "Piece 5" is comprised of the three manufactured pieces shown in FIG. 6B. Each of these pieces is of a different color: blue, red, and yellow. The completed puzzle (shown in FIG. 8) is a cube with adjacent faces of different color, and opposite faces of the same color.

OPERATION—FIGS. 7A TO 7F, 8

Figure 7A:
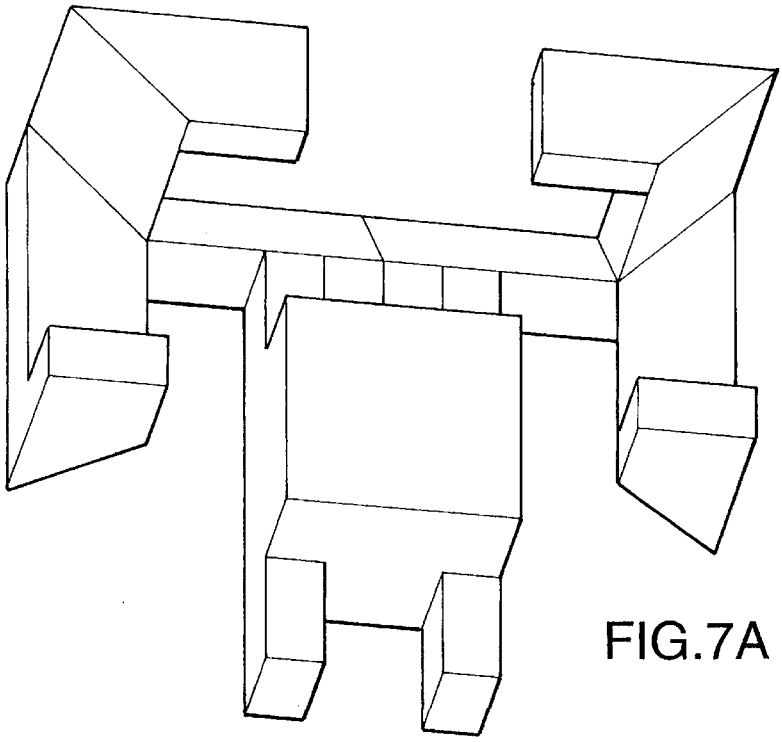
FIGS. 7A to 7F show the intermediary steps in assembling the puzzle

The following is one way to solve the puzzle:

1) Insert the blue portions of "piece 4" and "piece 5" into a blue "piece1", as shown in FIG. 7A.

Figure 7B:
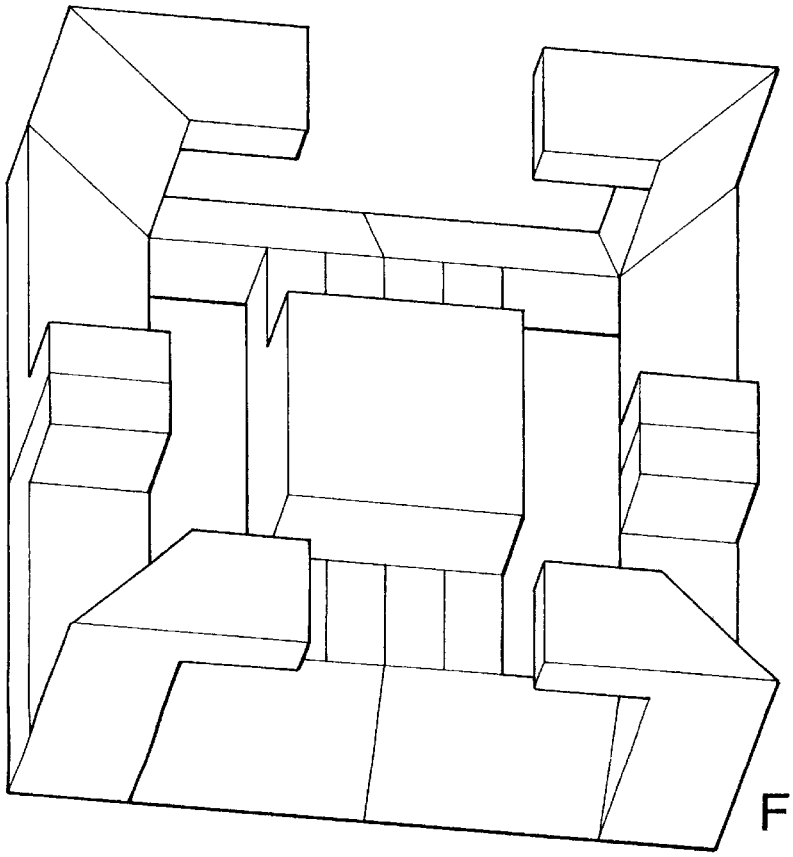

2) Insert the blue portions of another "piece 4" and "piece 5" into the "piece 1" of step 1, as shown in FIG. 7B.

Figure 7C:
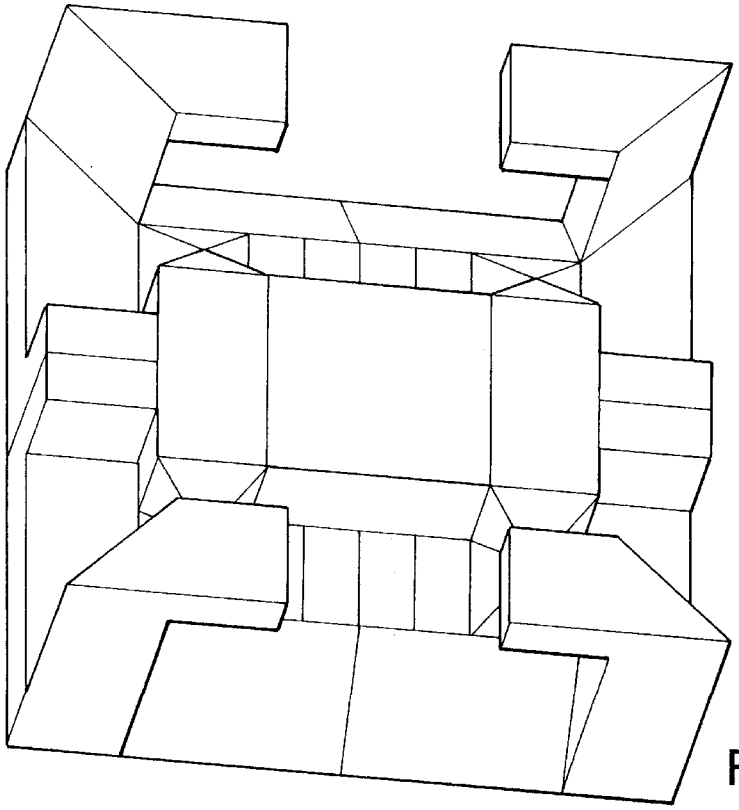
Figure 7D:
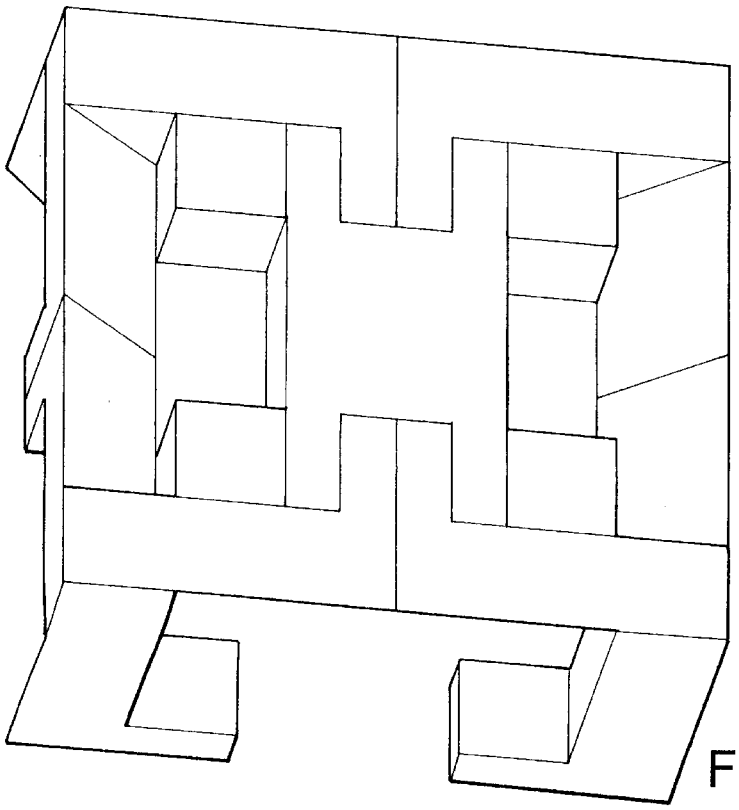

3) Insert two blue and yellow "piece 3"s into the assembly as shown in FIG. 7C, and shown from the reverse side in FIG. 7D.

Figure 7E:
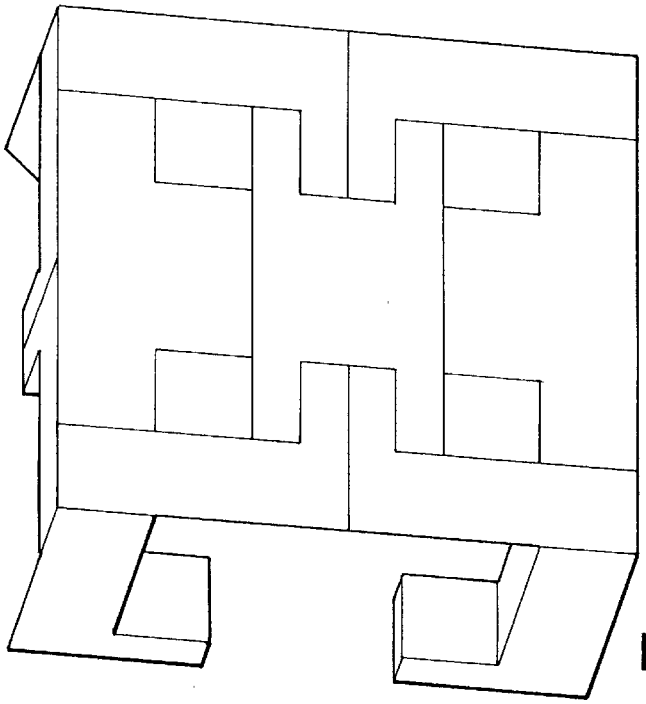

4) Insert two blue "piece 2"s into the assembly as shown in FIG. 7E. A smooth blue face is now completed.

Figure 7F:
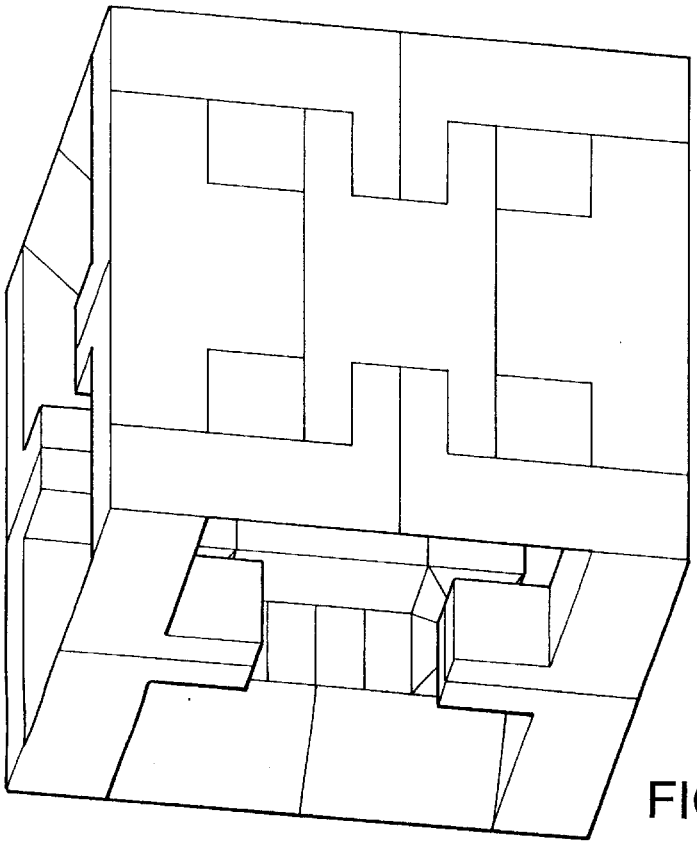

5) Repeat steps 1–4 with new pieces, to form two identical assemblies. Position two assemblies, with blue faces facing out, as shown in FIG. 7F.

Figure 8:
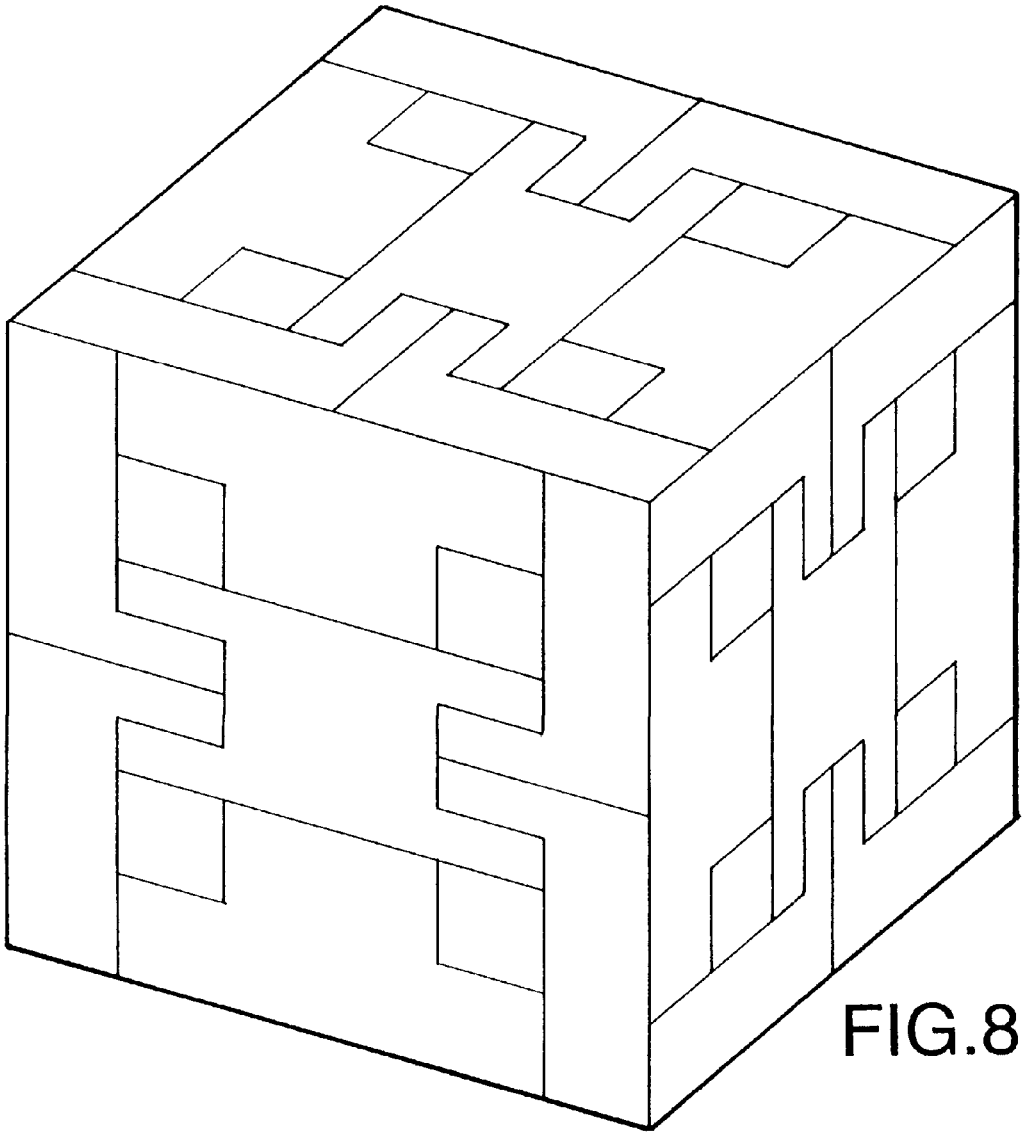
FIG. 8 shows the completed puzzle.

6) Complete the red and yellow faces by first inserting the remaining "piece 1"s, positioning them similarly to the blue "piece 1"s. Then insert the remaining "piece 3"s, positioning them similarly to the blue and yellow "piece 3"s And finally, insert the remaining "piece 2"s positioning them similarly to the blue "piece 2"s. The puzzle is now fully assembled as shown in FIG. 8.

What is claimed is:

1. A puzzle cube consisting of a plurality of colored, transparent components which are capable of being spatially interengaged to form a cube with a cubic void at its center, wherein when the cube is formed a primary color fills a volume defined by lines connecting points on the edges of an outer face of the cube to the corresponding points on the corresponding faces of the cubic void, and where volumes opposite one another are of the same primary color and volumes adjacent to one another are of a different color.

2. The puzzle cube of claim 1 wherein the plurality of components are not extrusions of two-dimensional forms or layers of two dimensional extrusions.

3. The puzzle cube of claim 2 wherein the cube has components symmetrical in form about any plane through the center of the cube.

* * * * *